US007426774B2

(12) United States Patent
Yamada

(10) Patent No.: US 7,426,774 B2
(45) Date of Patent: Sep. 23, 2008

(54) BUCKLE DEVICE

(75) Inventor: Naohiro Yamada, Atsugi (JP)

(73) Assignee: Ashimori Industry Co., Ltd., Osaka (JP)

( * ) Notice: Subject to any disclaimer, the term of this patent is extended or adjusted under 35 U.S.C. 154(b) by 0 days.

(21) Appl. No.: 10/574,490

(22) PCT Filed: Oct. 4, 2004

(86) PCT No.: PCT/JP2004/014978

§ 371 (c)(1),
(2), (4) Date: Nov. 2, 2006

(87) PCT Pub. No.: WO2005/034672

PCT Pub. Date: Apr. 21, 2005

(65) Prior Publication Data

US 2007/0107173 A1 May 17, 2007

(30) Foreign Application Priority Data

Oct. 7, 2003 (JP) ..... 2003-348475

(51) Int. Cl.
*A44B 11/25* (2006.01)
*A44B 11/26* (2006.01)

(52) U.S. Cl. ..... 24/641; 24/636; 24/645

(58) Field of Classification Search ..... 24/633, 24/636, 641, 640, 635, 637, 629
See application file for complete search history.

(56) References Cited

U.S. PATENT DOCUMENTS 4,388,746 A 6/1983 Krautz
4,393,557 A * 7/1983 Schmidt ..... 24/643
4,624,034 A * 11/1986 Ishiguro et al. ..... 24/641
4,797,984 A * 1/1989 Seto et al. ..... 24/641
5,159,732 A * 11/1992 Burke ..... 24/641
5,974,638 A 11/1999 Yamaguchi et al.
5,996,193 A 12/1999 Gill et al.
6,216,323 B1 * 4/2001 Oyamada ..... 24/641
6,701,587 B1 * 3/2004 Sato et al. ..... 24/633

FOREIGN PATENT DOCUMENTS

JP 57-107106 A 7/1982
JP 11-155611 A 6/1999
JP 11-266907 A 10/1999
JP 2001-046117 A 2/2001
JP 2001-199306 A 7/2001

* cited by examiner

*Primary Examiner*—Robert J. Sandy
(74) *Attorney, Agent, or Firm*—Sughrue Mion, PLLC

(57) ABSTRACT

A buckle device including a lock bar pushed by a release button for moving to a second position allowing rotation in a direction to release the engagement of a hook member, and a lock member rotated by a release button toward an unlock position at the time of releasing operation of a tongue plate. When the lock bar is butted against a first engagement part where the lock member is at a lock position, the lock member is rotated toward and held at the lock position, and a second engagement part enters a movement area of the lock bar, while an inertial force of the tongue plate in the direction of insertion thereof is exerted at a value exceeding a predetermined value, the release button is butted against a third engagement part to prevent the lock member from being rotated toward the unlock position to hold the lock position.

3 Claims, 8 Drawing Sheets

BUCKLE DEVICE

TECHNICAL FIELD

The present invention relates to a buckle device causing a tongue plate not to be released from a buckle body in case of an emergency of a vehicle such as a vehicle collision and so forth, particularly, to a buckle device having a structure wherein the tongue plate is not released from the buckle body even if a large acceleration is applied to the buckle body.

BACKGROUND TECHNOLOGY

In a seatbelt device equipped in a vehicle, there is provided a buckle device equipped with a tongue plate movably fitted on the middle of a webbing, and a buckle body through which the insertion and release of tongue plate is implemented. The buckle device is provided with a lock member for controlling the locking and unlocking of a lock bar for holding a lock position of the tongue plate so as to prevent the tongue plate from being released from the buckle body in case of an emergency of a vehicle such as a vehicle collision and so forth, wherein although the lock bar is normally kept at the lock position, when an operator releases the seatbelt, the lock member is rotated toward an unlock position, thereby causing the tongue plate to be released from the buckle body.

A buckle device disclosed in JP 6-66311 U (Patent Document 1) is provided with, as a fundamental structure, a buckle body, a hook member which is swingably supported by the buckle body and switchable to an engaged state or a disengaged state relative to a tongue plate, a lock pin which is supported by the buckle body and movable between a first position for holding the hook member in an engaged state and a second position where the hook member is released from the engaged state, a release button which is urged by a coil spring in the direction to pull out the tongue plate, and so forth.

Further, in the buckle device disclosed in this publication, a lock lever is rotatably pivotally supported in close proximity to the lock pin so as to make preparation in case of providing for drawing the buckle body toward a tightening side by a pretensioner so as to tighten the webbing in case of an emergency of a vehicle. At the time of insertion of the tongue plate, the lock lever is rotated and urged by a rotation urge member toward the lock position so as to cause the lock pin to be moved to the first position to hold the lock pin, while at the time of release of the tongue plate, the lock lever is forcibly rotated toward the unlock position so as to allow the lock pin to be moved to the second position.

Still further, at a position close to the lock lever, there is provided a sheet-like inertial body which is movably guided and supported in the direction to be moved to or away from the lock lever, and always urged by a spring member in the direction to be moved away from the lock lever. When the buckle body is stopped suddenly after it is drawn toward a webbing tightening side by the pretensioner which is operated in case of an emergency of a vehicle, the inertial body receives an inertial force at the lock lever side to be moved against an urging force of the spring member, thereby making contact with the lock lever to restrain the lock lever from being rotated toward the unlock position.

That is, the lock pin causes the lock lever to be rotated toward the unlock position, so that the hook member is rendered in engagement release, thereby preventing the tongue plate from being released from the buckle body.

Meanwhile, a buckle device disclosed in JP 4-58963 B (Patent Document 2) is provided with a lock mechanism capable of preventing the release of engagement of a latch member in addition to a latch member capable of engaging with and releasing from a tongue plate, an operation member for operating the release of engagement of the latch member, a lock member which is moved to a release position while interlocking with the operation of the operation member, thereby implementing the release of engagement of the latch member, and so forth. In this lock mechanism, there is provided a movement restraint member which is rotatably pivotally supported by the operation member and a part of which is intervened in a movement area of the lock member, wherein as a part of the rotating movement restraint member is present in the movement area at the time of generation of an impact, a moving lock member is butted against the movement restraint member to prevent the lock member from moving up to the release position.

In the buckle device disclosed in JP 6-66311 U (Patent Document 1), although the inertial body is moved to the lock lever side at the time of sudden stop of the buckle body, since the inertial force acting on the lock pin functions entirely as a force to cause the lock pin to be moved to the second position, there is a possibility that the lock pin is moved to the second position at very high speed.

That is, since there is a possibility that the lock lever is moved to the unlock position at very high speed, the inertial body which starts movement since the time of sudden stop of the buckle body does not normally make contact with the lock lever, resulting in arising a high possibility of not restraining the rotation of the lock lever toward the unlock position.

And also, there is a possibility that, although the lock lever pushes the lock pin to the first position at the time of insertion of the tongue plate, an oblique part of the rotating lock lever makes contact with the lock pin to transmit a force to the lock pin, resulting in failure of smooth implementation of the inserting operation of the tongue lever, and so forth. Further, since the lock lever, the inertia body, and urge members each urging these members must be provided, respectively, in order not to release the tongue plate from the buckle body owing to the operation of the pretensioner, the number of parts is increased to make the structure complex, and the assembly of the buckle device becomes complex, resulting in the disadvantage in a manufacturing cost.

Meanwhile, according to the buckle device disclosed in JP 4-58963 B (Patent Document 2), although a part of the movement restraint member is intervened in the movement trajectory of the lock member in a normal state, the movement restraint member is also rotated owing to the vehicle collision and so forth, resulting in arising a possibility that the lock member is not butted against the movement restraint member while the part of the movement restraint member is present in the movement area of the lock member, whereupon if such a case occurs, the latch member is released in engagement, so that the tongue plate is released.

Accordingly, in the buckle device provided with the tongue plate and the buckle body, there is proposed a buckle device as disclosed in JP 2001-46117 A (Patent Document 3) so as to reliably prevent the tongue plate from being released from the buckle body in case of an emergency of a vehicle, realize the smooth and reliable inserting and releasing operation of the tongue plate in a normal state, and simplify a structure to cause the tongue plate not to release from the buckle body in case of an emergency of the vehicle.

The present invention aims to add the improvement to the structure of the buckle device disclosed in the Patent Document 3, thereby solving the problem thereof more reliably.

The first object of the present invention is not to impair a normal working performance while a tongue plate is not released from a buckle body even at the time of operation of a pretensioner.

The second object is to assure the releasing operation by causing a lock bar to be moved merely in the direction to unlock a lock member after a second engagement part of the lock member is butted against the lock bar at the time of operation of a pretensioner and so forth.

The third object is to cause the lock member to generate a rotative force in the direction to hold a lock position so that the lock member holds the lock position for a period from the time when the lock member is moved away from the lock bar until the time when a third engagement part of the lock member is butted against a release button, which is caused by the sudden stop of drawing after the operation of the pretensioner.

DISCLOSURE OF THE INVENTION

An invention disclosed in claim 1 is a buckle device provided with a tongue plate connected to a webbing, and a buckle body through which the insertion and release of the tongue plate is implemented, characterized in that the buckle body comprises a frame, a hook member rotatably provided on the frame, rotatable at the time of insertion of the tongue plate to engage with the tongue plate, and always urged in a direction to release the engagement thereof, a release button for implementing the release of engagement between the hook member and the tongue plate, a lock bar moving to a position for allowing the rotation thereof in the direction to release engagement of the hook member while being pushed by the release button at the time of engagement releasing operation of the release button, and moving to a position where the rotation thereof is restrained in the direction to release the engagement of the hook member by the agency of an urging force of an urge member in a state of engagement with the tongue plate, a lock member rotatably pivotally supported by the frame between a lock position where the lock bar is locked and an unlock position where the lock bar is unlocked, and the urge member for elastically urging the lock member toward the unlock position, wherein the lock member comprises a base end part pivotally supported by the frame, a first engagement part formed on substantially the central portion of the base end part, a second engagement part formed opposite to the first engagement part while leaving a space through which the lock bar can be received, and a third engagement part provided opposite to the second engagement part and capable of entering a movement area of the release button, and wherein in a state where the lock member is positioned at the lock position, the lock member is rotated toward and held at the lock position when the lock bar is butted against the first engagement part, thereby causing the second engagement part to enter the movement area of the lock bar, while in the case where the inertial force in a direction of insertion of the tongue plate is exerted at a value exceeding a predetermined value, the release button is butted against the third engagement part, thereby preventing the lock member from being rotated toward the unlock position to hold the lock position.

An invention disclosed in claim 2 is a buckle device disclosed in claim 1, characterized in that a rotative force is generated in the lock member toward the unlock position when the lock bar is butted against the second engagement part in case of emergency, and a movement distance is provided so as to cause the release button to be butted against the third engagement part before or simultaneously with the movement of the lock member toward the second engagement part.

An invention disclosed in claim 3 is a buckle device disclosed in claim 1 or 2, characterized in that the lock member is rotatably pivotally supported by the frame by way of a pivotally support part which is eccentric from the center of gravity of the lock member, and an inertial force by which the lock member is rotated toward the lock position side is exerted owing to an inertial force in the direction of insertion of the tongue plate.

According to the invention disclosed in claim 1, there eliminates a need for designing the holding of the lock member by the engagement between the lock bar and the lock member in a case of emergency, and the holding of the lock member is implemented by the release button, so that the second engagement part of the lock member can be relatively freely designed. Further, even at the time of operation of the pretensioner, the tongue plate is prevented from being released, thereby not impairing a normal operation performance.

According to the invention disclosed in claim 2, since the lock bar is caused to be moved merely in the direction to unlock the lock member after the second engagement part of the lock member is butted against the lock bar at the time of operation of the pretensioner and so forth, the lock bar can be reliably released after operation thereof.

According to the invention disclosed in claim 3, the rotative force in the direction to hold the lock position is generated in the lock bar so that the lock member can hold the lock position for a period from the time when the lock member is moved away from the lock bar until the time when the third engagement part of the lock member is butted against the release button, which is caused by the sudden stop of drawing after the operation of the pretensioner.

BEST MODE FOR CARRYING OUT THE INVENTION

Figure 1:
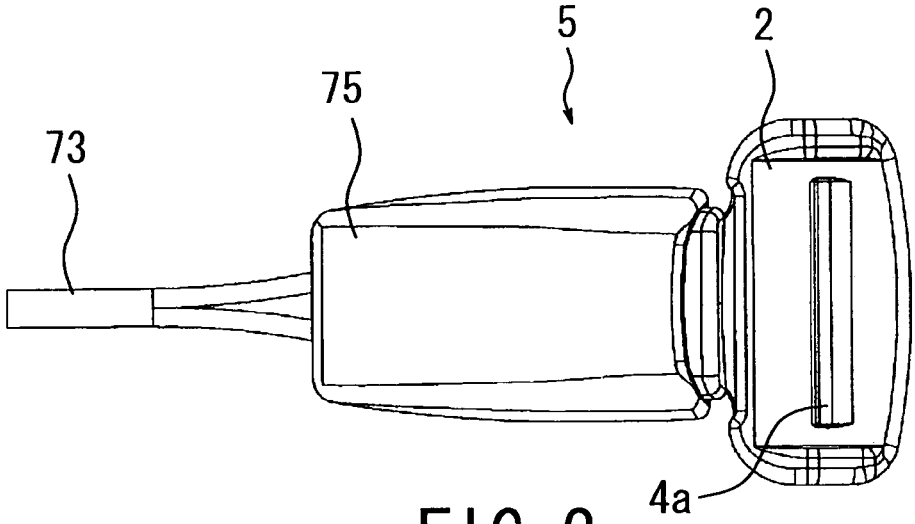
FIG. 1 is a plan view of a buckle device according to an embodiment of the present invention.
Figure 2:
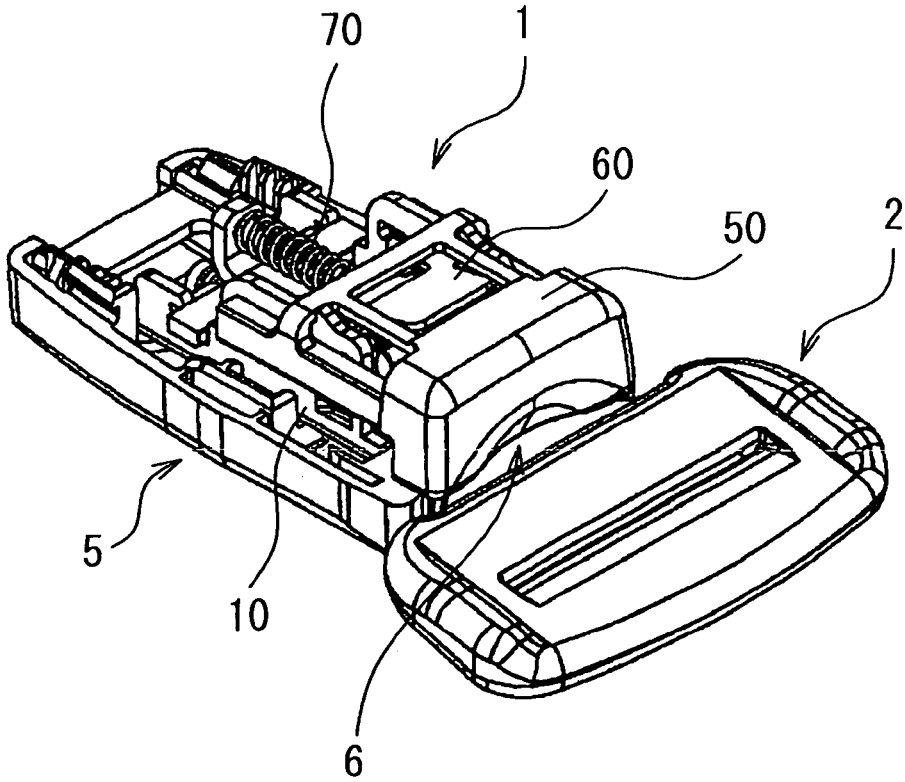
FIG. 2 is a longitudinal perspective view of the buckle device which is partly cut away.
Figure 3:
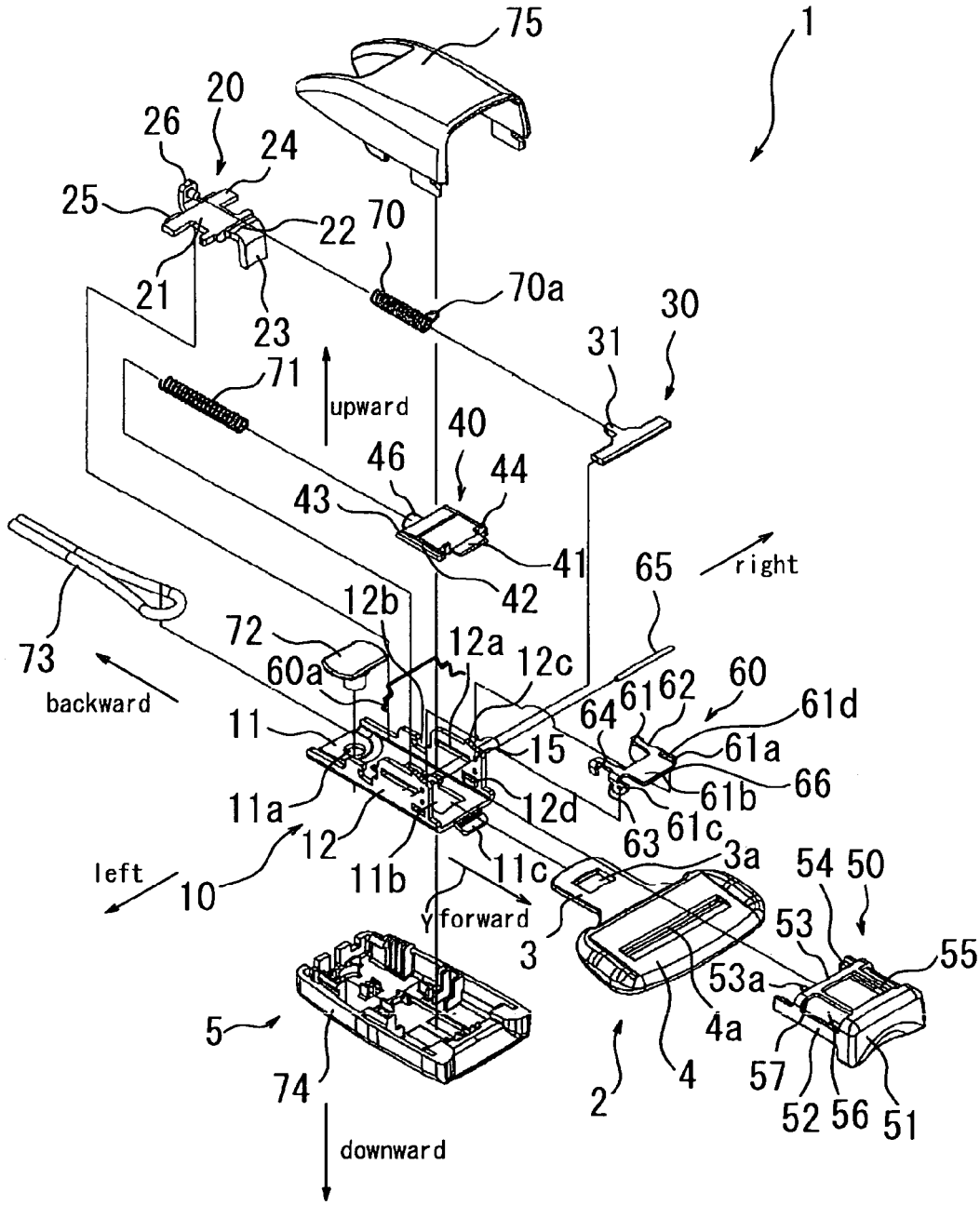
FIG. 3 is an exploded perspective view of the buckle device according to the embodiment of the present invention.

An embodiment of the present invention is now described hereinafter with reference to the drawings. There are provided, in a seatbelt device to be equipped in a vehicle, a buckle device for connecting a webbing fitted to an occupant to a car body side, and a pretensioner for drawing a buckle body of the buckle device toward a webbing drawing side so as to tighten the webbing in a case of emergency of a vehicle. FIG. 1 is a plan view of a buckle device according to an embodiment of the present invention, and the buckle device comprises a buckle body 5, a tongue plate 2 which is inserted from the front end part of the buckle body 5, a connection member 73 for causing the buckle body 5 to be connected to the pretensioner (not shown), and so forth. FIG. 2 is a perspective view of the buckle device shown in FIG. 1 wherein a lid cover 75 (FIG. 3) is removed, and shows a state of completion of insertion of the tongue plate 2. FIG. 3 is an exploded perspective view of the buckle device shown in FIG. 1.

The buckle device 1 is explained by defining the direction of back and forth, right and left for the convenience of explanation, assuming that a direction depicted by an arrow Y is forward as shown in FIG. 3.

Structure of the Buckle Device

FIG. 3 is an exploded perspective view of the buckle device according to the embodiment of the present invention. As shown in FIG. 3, the buckle device 1 comprises fundamentally a tongue plate 2 which is provided movably in the middle of a webbing (illustration is omitted), and a buckle body 5, wherein an insertion port 6 into which the tongue plate 2 is inserted is provided in the front end part of the buckle body 5 (FIG. 2). The tongue plate 2 includes a tongue part 3 made of metal which is to be inserted into the buckle body 5, and a tongue body 4 which is formed integrally with the tongue part 3 and covered with a synthetic resin material, wherein a rectangular engagement hole 3*a* is formed in the tongue part 3 and a webbing through hole 4*a* is formed in the tongue body 4.

Structure of the Buckle Body

The buckle body 5 comprises a frame 10, a hook member 20, a lock bar 30, an ejector 40 made of a synthetic resin, a release button 50 made of a synthetic resin, a lock member 60, compressed coil spring 70, 71, a connection member 73 fixed to the frame 10 by a rivet 72 for causing the buckle body 5 to be connected to a pretensioner (not shown), a base cover 74, a lid cover 75, respectively made of a synthetic resin, and so forth. All the parts except those made of a synthetic resin are made of metal (e.g. made of steel). Meanwhile, the lock member 60 may be made of a synthetic resin or metal. Further, the buckle body 5 may be connected to the pretensioner by way of a member other than the connection member 73.

Structure of the Frame

The frame 10 is formed by integrating a base plate 11 with a pair of side plate parts 12 each standing upright from both right and left side edges of the base plate 11. There are provided, on the base plate 11, a round hole 11*a* for the rivet 72, a rectangular hole 11*b* for housing the compressed coil spring 71 which elastically urges the ejector 40 forward, and guiding the movement of the ejector 40, a spring connection part (illustration is omitted) protruding from the rear end edge of the rectangular hole 11*b*, and an oblique part 11*c* which is engaged with the base cover 74.

There are provided, in a pair of side plate parts 12, a pair of long holes 12*a* into which both end parts of the lock bar 30 are inserted to slidably guide them back and forth, notched pivotally support parts 12*b* for rotatably pivotally support the hook member 20, a pair of stopper parts 12*c* for holding the release button 50 not to come off in the forward direction, and a pair of guide protrusion parts 12*d* for guiding the insertion and release of the tongue plate 2 and preventing the twisting of the tongue plate 2 when inserted. Further, there is formed, on the pair of side plate parts 12, a pair of shaft holes 15 for rotatably supporting a shaft member 65 extending horizontally while both ends of the shaft member are inserted therein.

Structure of the Hook Member

As shown in FIG. 3, the hook member 20 comprises a hook body 21, a restriction part 22 which is swelled in a curve upward in the forward direction from the hook body 21, a hook part 23 which is bent downward from the restriction part 22 and capable of being engaged in the engagement hole 3*a* of the tongue plate 2, and has a tip end which is engageable in the front end of the rectangular hole 11*b* of the base plate 11 of the frame 10, a pair of right and left parts 24 to be pivotally supported at the rear portion, a pair of parts 25 to be operated which are formed to be bent toward the lower side from the rear end part of the hook body 21, and operated by the ejector 40, and a spring receiver 26 which is bent toward the upper side from the middle of the parts 25 to be operated. A pair of right and left parts 24 to be pivotally supported are fitted onto the pair of notched pivotally support parts 12*b* of the pair of side plate parts 12, and the hook member 20 is rotatable up and down by a predetermined angle.

Structure of the Lock Bar

As shown in FIG. 3, the lock bar 30 made of a sheet-piece like member is suspendedly fitted onto the pair of side plate parts 12 in a state where it is inserted into the pair of long holes 12*a* formed in the base plate 11, while the right and left end parts of the lock bar 30 each protrude outside of the pair of side plate parts 12 by about 2 to 3 mm in the suspendedly fitted state, and the lock bar 30 is movable back and forth by a predetermined distance along the pair of long holes 12*a*. A spring receiver 31 is formed in the shape of projection at the center of the rear end part of the lock bar 30, and a coil spring 70 (equivalent to an urge member) is interposed in a compressed state between the spring receiver 26 of the hook member 20 and the spring receiver 31 of the lock bar 30, whereby the lock bar 30 is urged forward and the hook part 23 of the hook member 20 is always urged upward (in the direction to release the engagement of the tongue plate 2).

In a state where the tongue plate 2 is engaged with the hook member 20 while inserted into the buckle body 5, the lock bar 30 is positioned at the first position P1 (FIG. 12A, FIG. 12B) corresponding to the front end parts of the pair of long holes 12*a* (FIG. 3) to press the restriction part 22 from above, thereby restraining the rotation of the hook member 20 in the direction to release the engagement of the hook member 20 (upward), while at the time of engagement releasing operation of the release button 50, the lock bar 30 is pushed to be moved backward by the release button 50, to be positioned at the second position P2 (FIG. 12D, FIG. 12E) corresponding to the rear end parts of the pair of long holes 12*a* and moved behind the restriction part 22, thereby allowing the hook member 20 to be rotated in the direction to release the engagement of the hook member 20. Further, there is provided, at the front end of the coil spring 70, a push part 70*a* (FIG. 3) which is integrated with the coil spring 70, and protrudes upward over an outer diameter of a wound wire. In a state where the tongue plate 2 is engaged in the hook member 20 while inserted into the buckle body 5, the push part 70*a* (FIG. 3) is butted against an upper end wall part 53 provided at the upper end of the release button 50, thereby urging the release button 50 forward, so that the release button 50 is held by the pair of stopper parts 12*c* (FIG. 3) to be stopped at an advance limit position. That is, the lock bar 30 and the release button 50 are urged forward by one coil spring 70.

Structure of the Ejector

As shown in FIG. 3, the ejector 40 is provided with an oblique guide part 41 at the front end, parts 42 to be guided at both the right and left end parts, an operation part 43 at the rear end for causing the pair of parts 25 to be operated of the hook member 20 to be pushed backward to cause the hook member 20 to be rotated in an engagement direction at the time of insertion of the tongue plate 2, a pair of right and left push parts 44 for causing the release button 50 to be push forward at the time of release of the tongue plate 2, a spring connection part 46 to be connected to the front end of the coil spring 71, and so forth. The ejector 40 is disposed to be movable back and forth over the base plate 11 of the frame 10, and the pair of parts 42 to be guided each have U-shape in a cross section, wherein when the parts 42 having the substantially U-shape in a cross section is engaged in both side edges of the rectangular holes 11*b*, they are guided without being floated.

The front end part of the coil spring 71 is connected to the spring connection part 46 in a state to be inserted, while the rear end thereof is connected to a spring connection part (illustration is omitted) of the base plate 11 so that the ejector 40 is urged elastically forward (i.e. in a release direction of the tongue plate 2) relative to the frame 10 by the agency of the urging force of the coil spring 71.

Structure of the Release Button

As shown in FIG. 3, the release button 50 is provided with a front end wall part 51 at the front end, a pair of right and left guide wall parts 52, an upper wall part 53 at the upper end. The pair of guide wall parts 52 are positioned in close proximity to the outside of the pair of side plate parts 12 of the frame 10, respectively, and a pair of guide grooves 54 for guiding both end parts of the lock bar 30 each protruding toward the outside of the pair of long holes 12*a* of the frame 10 are formed on the pair of guide wall parts 52.

Figure 8:
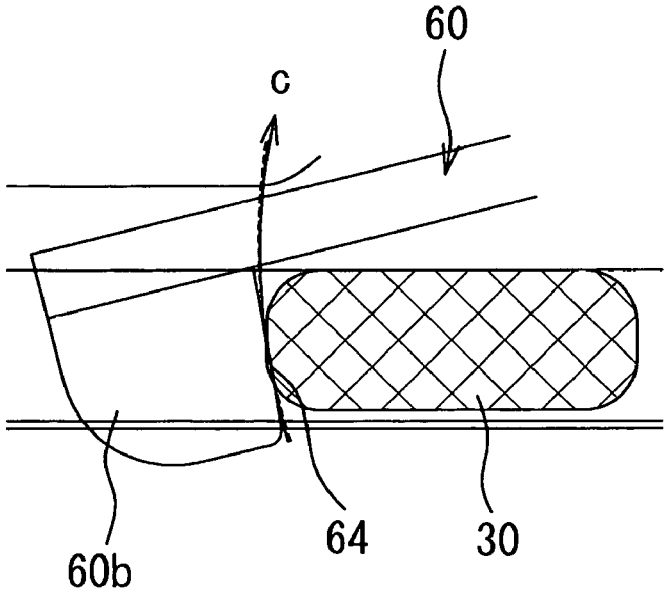
FIG. 8 is an enlarged view of a part A in FIG. 7.
Figure 9:
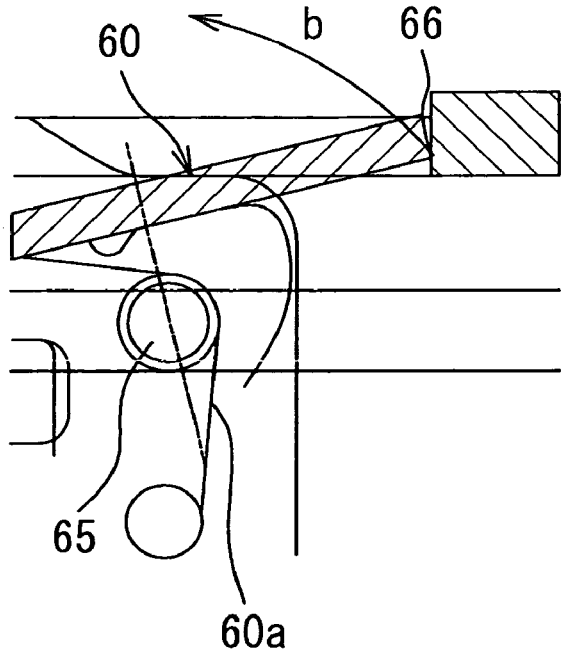
FIG. 9 is an enlarged view of a part B in FIG. 7.

FIG. 8 and FIG. 9 are enlarged views each showing the relationship between the lock member and the lock bar, and operation explanation view showing the operation of the buckle body at the time of sudden stop thereof. As shown in FIG. 6 to FIG. 9, the lock member 60 can not restrain the movement of the lock bar 30 because it obtains a rotative force in a release direction of the buckle device by the lock bar 30.

To cope with this, there is provided a third engagement part 66 of the lock member 60 which is butted against the rear face of the front wall part 51 of the release button 50 so as to hold the restraint position.

When the release button 50 is moved backward at the time of release of the tongue plate 2 from the buckle body 5, a pair of lock bar push parts 55 (FIG. 3) formed in the pair of guide wall parts 52 are butted against both end sides of a first position side end part (front end part) 30*a* each protruding toward the outside of the pair of long holes 12*a*, thereby implementing a pushing operation to cause the lock bar 30 to be moved to the second position P2.

As shown in FIG. 3, a pair of right and left slits 56 are formed on the upper wall part 53 of the release button 50 for allowing the release button 50 to be moved back and forth relative to the pair of stoppers 12*c* of the pair of side plate parts 12. At the time of insertion of the tongue plate 2, the lock bar 30 is moved from the second position P2 to the first position P1 by the agency of the urging force of the coil spring 70, and the release button 50, which is urged forward by the push part 70*a* of the coil spring 70, is stopped at the advance limit position since a pair of parts 57 to be held and provided at the rear ends of the pair of slits 56 are held by the pair of stoppers 12*c*.

There is provided, on the inner face of the front wall part 51 of the release button 50, a pair of parts to be pushed which are butted against the pair of push parts 44 of the ejector 40 to be pushed forward at the time when the tongue plate 2 is released from the buckle body 5, wherein the release button 50 is pushed forward in the release direction of the tongue plate by the ejector 40 which is urged by the agency of the urging force of the coil spring 71 together with the tongue plate 2 to return the release button 50 to an advance limit position, thereby causing the ejector 40 to be stopped. Even in this state, the ejector 40 is stopped while leaving a slight gap between itself and the front end of the rectangular hole 11*b* (FIG. 3) formed in the frame 10 so as to push the release button 50 forward upon reception of the urging force of the coil spring 71.

There is provided, on the upper end wall part 53 of the release button 50, a pair of right and left press-down parts 53*a* (FIG. 3) each protruding backward. The press-down parts 53*a* protrude downward in a convex shape from the upper end wall part 53 and make contact with the upper faces of a pair of right and left lever parts 62 of the lock member 60, described later, in a state where the release button 50 is returned to the advance limit position, so that the upper faces of the pair of right and left lever parts 62 of the lock member 60 are pushed downward by the agency of the elastic force of the press-down part 53*a*, causing the lower end of the second engagement part 64 of the lock member 60 to be pushed on the upper face of the lock bar 30, whereby the movable parts such as the lock member 60, the lock bar 30, the hook member 20, and so forth, which are mechanically interlocked with each other, are vibrated, to be restrained not to generate a different noise.

Structure of the Lock Member

As shown in FIG. 3, the lock member 60 includes a long base end part 61 which is disposed between the pair of side plate parts 12 of the frame 10 and is long in a lateral direction, and the pair of lever parts 62 each substantially extending backward from right and left both end parts of the base end part 61. The base end part 61 comprises a pair of right and left both end side plate parts 61*a* and a horizontal part 61*b* for connecting upper end parts of the side plate parts 61*a*, wherein the horizontal part 61*b* protrudes forward and a third engagement part 66 is formed at the end part of the horizontal part 61*b*. A pair of pivotally support holes 61*c*, which are eccentric downward relative to the center of graving G of the lock member 60 (FIG. 11), are formed concentrically with each other on the side plate parts 61*a*, and the shaft member 65 is inserted into the pivotally support holes 61*c* (FIG. 3). Both ends of the shaft member 65 are inserted into a pair of shaft holes 15 of the frame 10, whereby the base part 61 of the lock member 60 is rotatably pivotally supported by the frame 10 by way of the shaft member 65.

A rib 61*d* is integrally formed on the base part 61 of the lock member 60 at the position close and opposite to the right side plate part 61*a*. An insertion hole (illustration is omitted) through which the shaft member 65 is inserted is formed in the rib 61*d*. A twist spring 60*a* (elastic member) is disposed between the side base part 61*a* and the rib 61*d* which are opposite to each other, and the shaft member 65 is inserted into the twist spring 60*a*. One end of the twist spring 60*a* is fitted to the horizontal part 61*b* of the lock member 60 from below in a contacted state while the other end thereof is fitted to a spring fit hole (not shown) of the frame 10 in an inserted state, whereby the lever part 62 is always elastically urged upward by the twist spring 60*a*. The rib 61*d* may be omitted.

The lock member 60 includes a pair of first engagement parts 63 provided in the proximity to the base part 61, a pair of second engagement parts 64 each provided at the tip end of the pair of lever parts 62 and facing the pair of first engagement parts 63 with an interval through which the lock bar 30 can be received, and the third engagement part 66 disposed opposite to the second engagement part 64 facing the first engagement part 63 and capable of entering the inside of a movement area of the release button 50, wherein the lock member 60 is rotatably pivotally supported by and extended between the lock position (FIG. 6) where the lock bar 30 is locked at the first position P1 and an unlock position where the lock bar 30 is not locked (FIG. 12D, FIG. 12E), and the lock member 60 is always elastically urged by the twist spring 60*a* toward the unlock position.

Figure 12A:
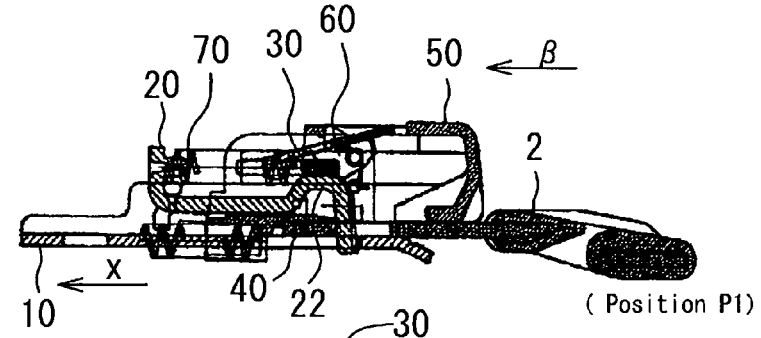
FIG. 12 is a view explaining the operation for illustrating a releasing operation of the tongue plate.
Figure 12B:
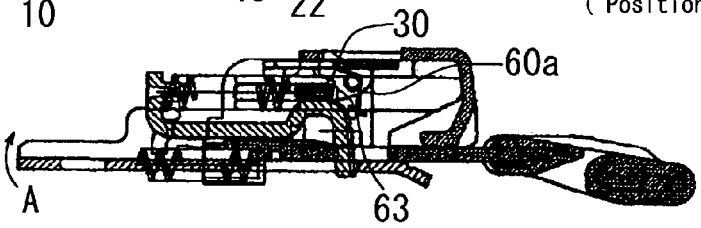
Figure 12C:
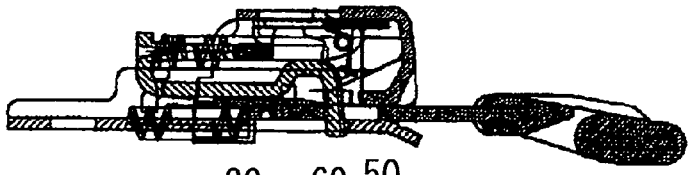
Figure 12D:
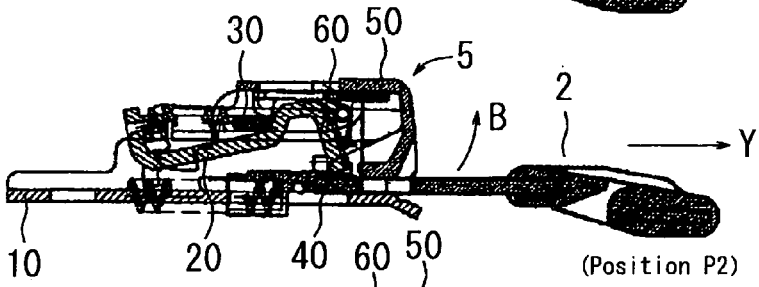

The first engagement part 63 is provided to be butted against a first position side end part 30*a* (front end part) of the lock bar 30, and the lock member 60 is rotatably urged toward the unlock position in a state where the tongue plate 2 is not inserted, namely, in a state where the lock bar 30 is positioned at the second position P2 (FIG. 12D).

Whereupon, the base part 61 of the lock member 60 is pivotally supported by the frame 10 at the position remote from a face including the movement area of the lockbar 30 and opposite to the hook member 20, namely, at the position of front oblique upper side of the movement area of the lock bar 30. Accordingly, the lock bar 30 urged toward the first position P1 is butted against the first engagement part 63 to cause the lock member 60 to be rotated toward the lock position, and in this state, the lock bar 30 is butted against the first engagement part 63 (FIG. 12A) to hold the lock position. At the lock position, the second engagement part 64 which enters the movement area of the lock bar 30, approaches and opposes a second position side end part 30*b* (rear end part), causing the second engagement part 64 to be butted against the second position side end part 30*b*.

Figure 11:
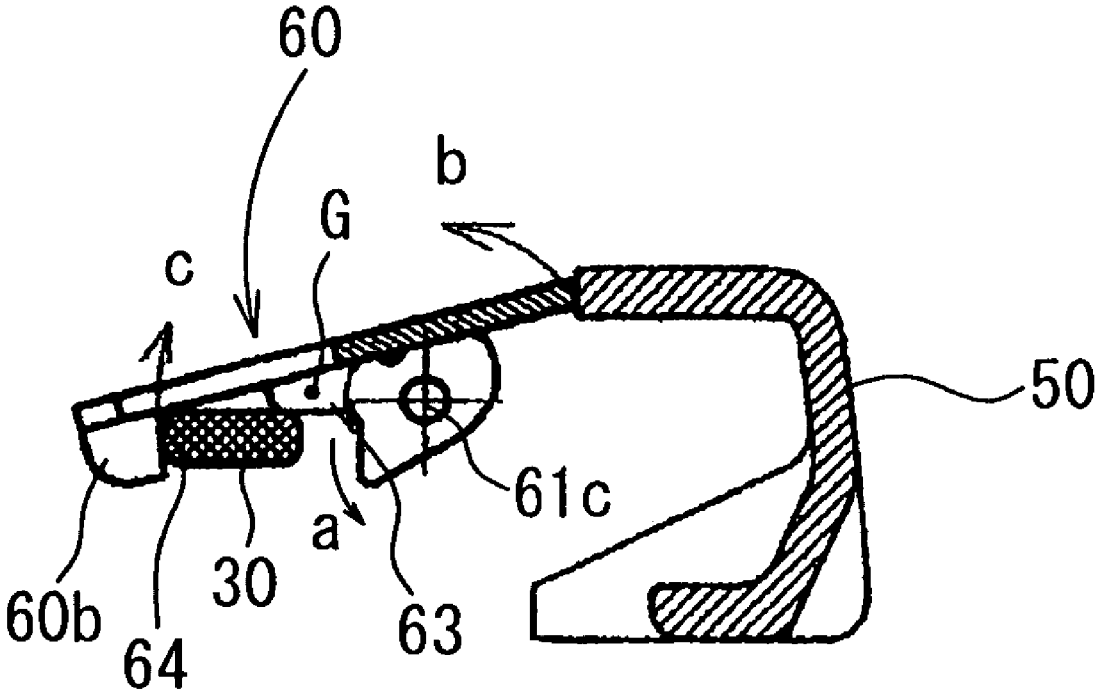
FIG. 11 is an image view showing the relation of a rotative force.

Meanwhile, as shown in FIG. 8, the second engagement part 64 of the lock member 60 is substantially a straight line, and it is formed in a shape gently inclined forward and downward obliquely in a state where the lock member 60 is positioned in proximity to the unlock position so as to generate rotative force for causing the lock member 60 to be rotated toward the unlock position side (in the direction of c) when making contact with the lock bar 30 moving to the second position P2 side. Further, at the time of sudden stop of the buckle body 5 after the operation of the pretentioner, an inertial force acts upon the buckle body 5 (lock member 60) in a backward direction, but a center of gravity G of the lock member 60 is provided above the pivotally support holes 61*c* (rotary axis) of the lock member 60 so as to cause the lock member 60 to be rotated toward the lock position by the agency of the inertial force acting upon the center of gravity G of the lock member 60 (FIG. 11).

The connection member 73 is fixed to the frame 10 by way of the rivet 72, as shown in FIG. 3, and the hook member 20, the lock bar 30, the ejector 40, the release button 50, the lock member 60, the coil springs 70, 71, and so forth are assembled on the frame 10, whereby these components are assembled in a state to be housed inside the space between the base cover 74 and the lid cover 75, and the base cover 74 and the lid cover 75 are integrated with each other in a fixed state by way of a plurality of fit parts and engagement parts. The front end of the release button 50 faces the front end of the buckle device 1, wherein when the front end of the release button 50 is configured to be rendered push-operable by a finger.

Operation of the Buckle Device

The operation of the buckle device 1 described above is now explained with reference to FIGS. 4 to 10.

Figure 4:
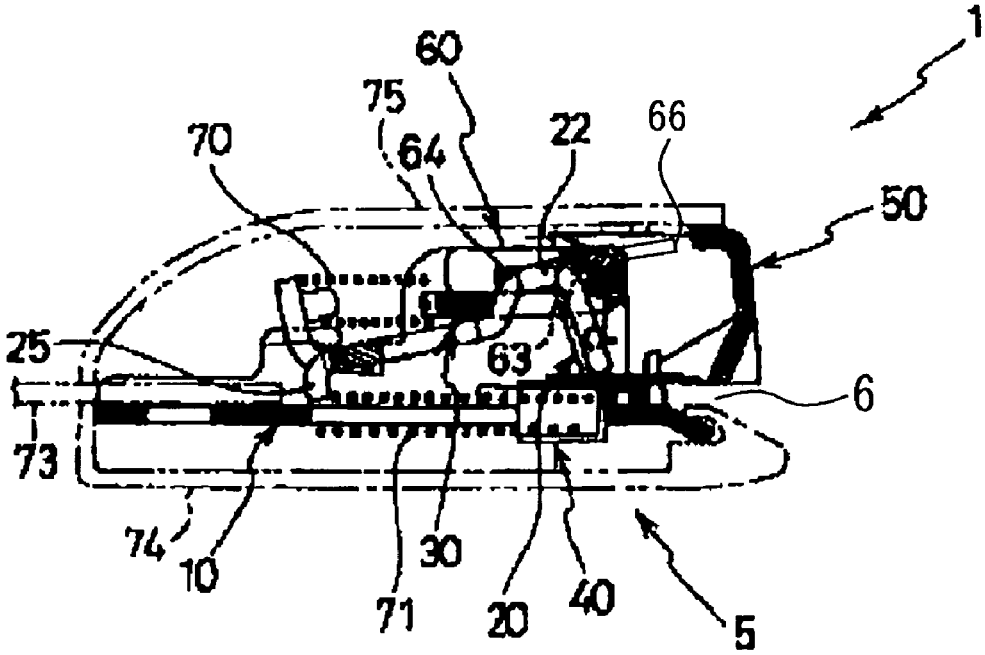
FIG. 4 is a longitudinal sectional side view of the buckle device (in a state where a tongue plate is not inserted)

FIG. 4 shows a state where the tongue plate 2 is released from the buckle body 5, wherein the lock member 60 is urged by the twist spring 60*a* (FIG. 5) toward the unlock position. From this state, when the tongue part 3 of the tongue plate 2 is inserted into the buckle body 5 through the insertion port 6, the tongue part 3 is first butted against the front end of the ejector 40.

Subsequently, when the tongue plate 2 is inserted into the buckle body 5 to push the ejector 40 (FIG. 3) against the urging force of the coil spring 71, the pair of the operation part 43 provided at the rear end of the ejector 40 is butted against the pair of parts 25 to be operated of the hook member 20 to cause the parts 25 to be rotated backward, so that the hook member 20 is rotated in the engagement direction against the urging force of the coil spring 70 to engage in the engagement hole of the tongue part 3, while the lock bar 30 is moved forward from the second position to the first position by the agency of the urging force of the coil spring 70.

Figure 5:
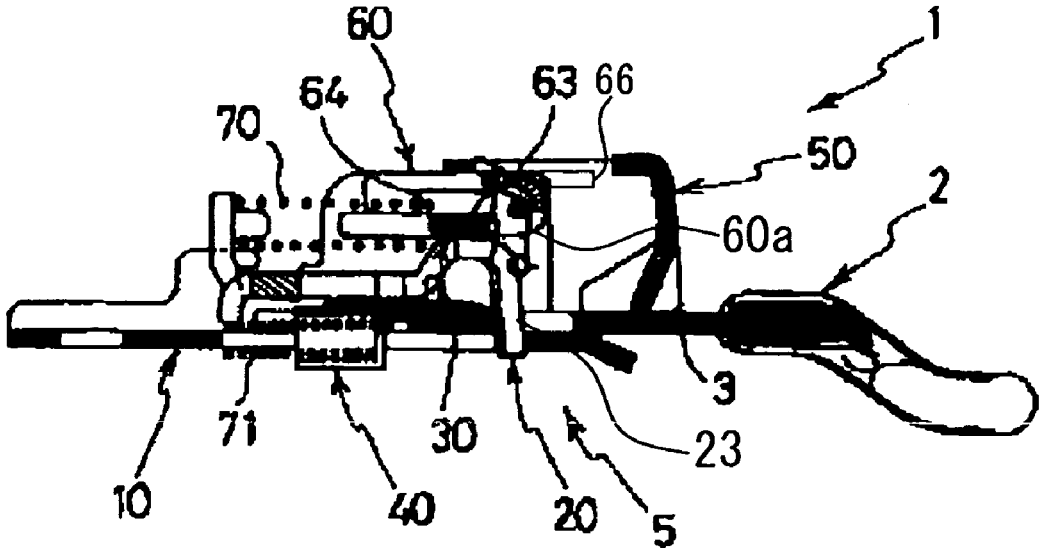
FIG. 5 is a longitudinal sectional view of the buckle device (in a state where a tongue plate is inserted)
Figure 6:
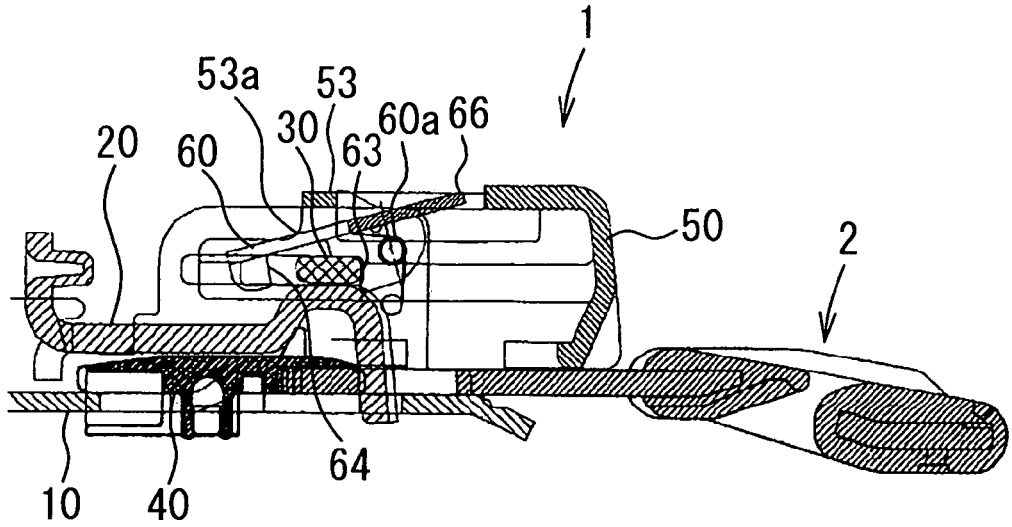
FIG. 6 is an enlarged view for explaining the relationship between a lock member and a lock bar.
Figure 7:
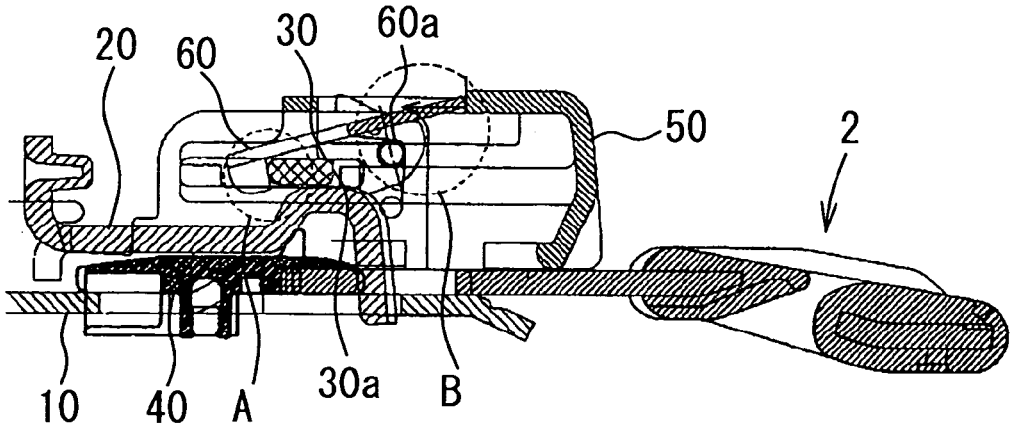
FIG. 7 is an enlarged view for explaining the relationship between the lock member and the lock bar (at the time of butting of a third engagement part)

Since the lock member 60 is positioned at the unlock position while since the second engagement part 64 does not enter the movement area of the lock bar 30 at the time when the lock bar 30 is moved from the second position to the first position, the lock bar 30 does not interfere with the second engagement part 64 while the first position side end part of the lock bar 30 is butted against the first engagement part 63 as shown in FIG. 5, subsequently, causing the lock member 60 to be moved to the lock position. Thereupon, the lock bar 30 is received between the first and the second engagement parts 63, 64, and in this state, the first position side end part of the lock bar 30 is butted against the first engagement part 63 to hold the lock position while the second engagement part 64 enters the movement area of the lock bar 30, causing the second engagement part 64 to approach and oppose the lock bar 30.

In a state where the tongue part 3 of the tongue plate 2 is inserted into the buckle body 5 to engage the tongue plate 2 with the hook member 20, the hook part 23 is engaged in the engagement hole 3*a* (FIG. 3) and the rectangular hole 11*b* of the frame 10 (FIG. 3) to hold the tongue part 3. Further, the lock bar 30 is positioned at the first position to be butted against the upper face of the restriction part 22 of the hook member 20, thereby restricting the rotation of the hook member 20 in an engagement release direction, while the pair of parts 57 to be engaged of the release button 50 (FIG. 3) are held by the pair of stopper parts 12*c* (FIG. 3), causing the release button 50 to stop at the advance limit position. In this engaged state, both end parts of the lock bar 30 are butted against the pair of receiver parts 55 of the release button 50 so that the release button 50 is urged forward by the lock bar 30 which receives the urging force of the coil spring 70.

Figure 10A:
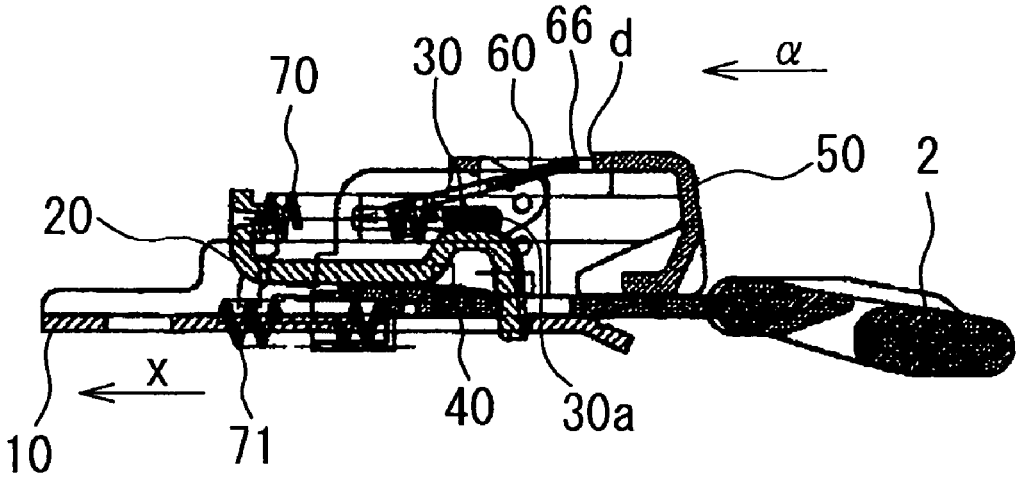
FIG. 10 is an operation explanation view at the time of a shock-resistance operation.
Figure 10B:
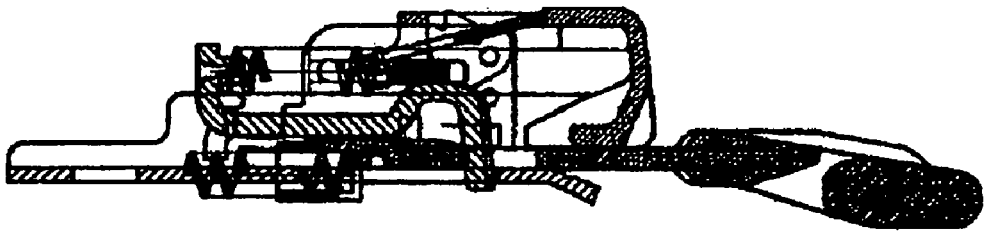

FIG. 10 is an operation explanation view at the time of shock-resistance operation, and FIG. 12 is a view showing a normal releasing operation of a tongue plate. FIG. 12 shows each stage from the state, where the tongue plate 2 is inserted into the buckle body (FIG. 12A) to a state where the tongue plate is completely released from the buckle body by pushing the release button 50 by a finger (FIG. 12E).

When an inertial force $\alpha$ is exerted in a state where the insertion of the tongue plate 2 is completed as shown in FIG. 10A, the release button 50 and lock bar 30 start the movement in an X direction which is a release direction of the buckle device 1. At the same time, the lock member 60 is liable to be rotated in an "a" direction by the center of gravity G (FIG. 11), causing a hook part 60*b* to stay in a movement trajectory of the lock member 60.

The tip end face d provided at the rear face of the release button 50 reaches the third engagement part 66 of the lock member 60 until the release button 50 is moved to a position where the buckle device 1 can be released, and further movement of the release button 50 is prevented. At this point in time, the lock bar 30 does not yet reach the hook part 60*b* of the lock member 60. The hook part 60*b* of the lock member 60 stays in the movement trajectory of the lock bar 30.

Figure 10C:
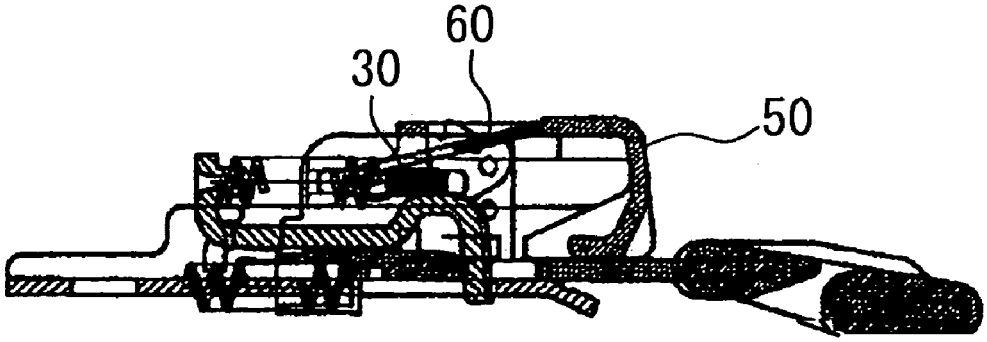

As shown in FIG. 10C, the lock bar 30 reaches the hook part 60*b* of the lock member 60 slightly later than the time when the tip end face d provided at the rear face of the release button 50 reaches the lock member 60.

At this point in time, based on FIG. 11, supposing that a force in the "a" direction owing to the center of gravity G per se is a1, while a force in a "b" direction acting on the third engagement part 66 of the lock member 60 by the release button 50 is b1 (FIG. 7), and a force in a "c" direction acting on the second engagement part 64 of the lock member 60 by the lock bar 30 is c1 (FIG. 6), a relational expression of a rotative force comprising a1+b1>c1+an urging force applied to the lock member 60 is established in the lock member 60.

The buckle device 1 is not released since this relational expression is maintained.

FIG. 12 shows a normal releasing operation.

As shown in FIG. 12A, at the time of release of the buckle device, when an illustrated releasing operation β is applied by the occupant to the release button 50, the release button 50 is moved to an X direction, and at the same time, the lock bar 30 is also pushed and moved by the release button 50.

When the lock bar 30 is moved, the lock bar 30 is moved away from the first engagement part 63 of the lock member 60.

At the same time, the lock member 60 loses a rotative force in an A direction obtained by the lock bar 30, so that the lock member 60 is rotated in the direction of A by the twist spring 60*a*.

At this point in time, the hook part of the lock member 60 is rotated outside the movement trajectory of the lock bar 30. (FIG. 12B)

When the release button 50 is further pushed in by the operation of the occupant, the lock bar 30 is moved to a position where the rotation of the hook member 20 in a release direction can not be prevented. (FIG. 12C)

The hook member 20 is rotated toward a position where the tongue plate 2 is allowed to come out from the inside of the buckle body 5 (Y direction) by the rotative force in a B direction from the coil spring 70 (lock bar 30) and the tongue plate. Then, the tongue plate 2 is released from the buckle body 5. (FIG. 12D)

The tongue plate 2 is kicked out outside the buckle body 5 by the ejector 40, and the release button 50 is also returned to the original position by the ejector 40. Then it becomes in a standby state.

Explanation of a Principle of Shock-Resistance Mechanism

Explained with reference to FIGS. 6 to 11, the lock bar 30 is moved in a "c" direction of the release allowance position of the buckle device 1 (FIG. 8) by the agency of the inertial force generated in the pretentioner and so forth and reaches the hook part 60*b* of the lock member 60. At an angle of the second engagement part 64 provided at the hook part 60*b* of the lock member 60, the lock member 60 can not restrain the movement of the lock bar 30 because the lock member 60 obtains a rotative force by the lock bar 30 in the direction to release the buckle device 1. However, as shown in FIG. 9, the forward protrusion end part (third engagement part) 66 of the lock member 60 is provided in front of the hook part 60*b* to cope with the rotative force applied to the lock member 60 by the lock bar 30, so that the restraint position of the lock member 60 is held.

Release Mechanism after the Operation of Shock-Resistance Mechanism

There is a case where the lock bar 30 is held at an operation position of the shock-resistance mechanism (position in FIG. 8) when a tensile force of the buckle device 1 is held even after the completion of the operation of the shock-resistance mechanism. Since a rotating trajectory of the hook part 60*b* of the lock member 60 is designed to be the confines of the lock bar 30, the lock bar 30 can be rotated at a release allowance position by the twist spring (urge member) 60*a*.

As shown in FIG. 12, in a state of insertion of the tongue plate 2, the second engagement part 64 (FIG. 8) enters the movement area of the lock bar 30 to approach and oppose the lock bar 30, but when the lock bar 30 starts the movement from the first position P1 to the second position P2, the lock bar 30 is moved away from the first engagement part 63 so that the lock member 60 starts the rotation toward the unlock position side. Accordingly, when the lock member 60 is rotated toward the unlock position, as shown in FIG. 12D, the lock bar 30 is moved to the second position P2 without making contact with the second engagement part 64.

Then as shown in FIG. 12D, in a state where the lock bar 30 reaches the second position P2, the lock bar 30 is moved behind the restriction part 22 not to be butted against the restriction part 22 so that the hook member 20 is rotated upward at its maximum to be rendered in an engagement released state.

Although the tongue plate 2 is released forward from the buckle body 5 in this engagement released state, since the front end of the ejector 40 is butted against the rear end of the tongue plate 2 at this point in time, the tongue plate 2 is urged forward to come out from the buckle body 5.

Figure 12E:
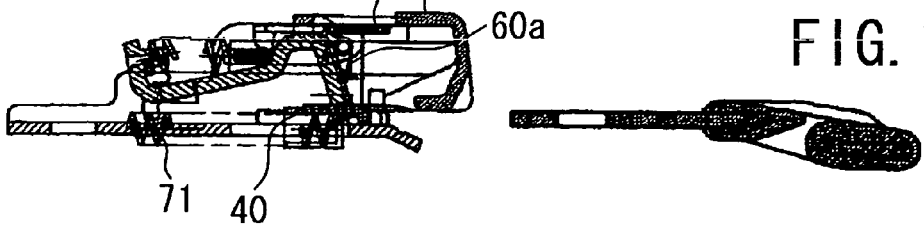

Since the pair of right and left push parts 44 of the ejector 40 (FIG. 3) are butted against a pair of parts to be pushed of the release button 50, when the finger is released from the release button 50, the release button 50 is urged forward by the ejector 40 which is urged by the agency of the urging force of the coil spring 71, as shown in FIG. 12E, so that the release button 50 is returned to the advance limit position.

In case of an emergency of a vehicle such as a vehicle collision and so forth, the pretentioner operates so that the buckle body 5 is drawn toward the tensioning side of the webbing by a predetermined amount, causing the occupant to be forcibly restrained by the webbing, while in the buckle device 1, the lock member 60 and so forth operate such that the tongue plate 2 is not released from the buckle body 5.

When the pretensioner operates, the buckle body 5 is drawn toward the tensioning side of the webbing, i.e. backward, and stopped later immediately, however, the lock member 60 receives the forward facing inertial force immediately after the start of the backward movement of the buckle body 5. At this point in time, the inertial force is exerted as an rotative force for causing the lock member 60 to be rotated toward the unlock position, while the inertial force acts also upon the lock bar 30 in the direction of the first position P1, so that the mass and the urging force of the lock member 60 and the lock bar 30, pivotally support position of the lock member 60 and so forth are set so as to press the lock member 60 by the lock bar 30 by the agency of the inertial force acting on the lock bar 30 and the urging force of the coil spring 70 for urging the lock bar 30 to the first position P1 so as to press the lock member 60 by the lock bar 30 to be held at the lock position.

Meanwhile, after the operation of the pretensioner, the lock bar 30 is returned to the first position P1 from the second position P2 by the agency of the urging force of the coil spring 70, whereby the lock member 60 is held at the lock position to be returned to a normal state so that the passenger can freely implement the insertion and release of the tongue plate 2 relative to the buckle body 5.

OPERATION OF THE PRESENT INVENTION

The operation and function of the present invention are now explained with reference to FIG. 10 and FIG. 12.

When the tongue plate 2 is inserted into the buckle body 5, the tongue part 3 is butted against the lockmember 60, causing the lock member 60 to be rotated toward the lock position. When the inertial force in the direction to release the tongue plate acts on the buckle body 5, the lock bar 30 receives a force at the first engagement part 63 side to hold the lock position, thereby restraining the rotation of the hook member 20 in the direction to release the engagement thereof. When the inertial force acts on the buckle body 5 in the direction to insert the tongue plate, the lock bar 30 is moved to the second engagement part 64 side, but the third engagement part 66 is butted against the release button 50, causing the lock member 60 not to be rotated toward the unlock position so that the lock bar 30 stays at the second engagement part 64, so that the tongue plate 2 is not released. When the release button 50 is operated, the lock bar 30 is pushed out from the first engagement part 63 and the urged lock member 60 is moved to the unlock position but the lock member 60 is rotated by the twist spring 60*a* toward the unlock position, so that the third engagement part 66 is not butted against the release button 50, thereby not preventing the rotation toward the unlock position, whereby the hook member 20 is rotated in the direction to release the engagement thereof, so that the tongue plate 2 can be released.

Further, since the lock member 60 is rotated by the twist spring 60*a* toward the unlock position, even if the release button 50 is quickly pressed manually or by something at the time of collision, the lock is released.

When the inertial force acts on the buckle body 5 in the direction to insert the tongue plate, the lock bar 30 is liable to be butted against the second engagement part 64, causing the lock member 60 to be rotated toward the unlock position, but the third engagement part 66 is butted against the release button 50 before or simultaneously with the rotation of the lock member 60, so that the lock member 60 stays at the lock position and the tongue plate 2 is not released.

When the inertial force acts on the buckle body 5 in the direction of insertion of the tongue plate (in the case where the operation of the pretentioner suddenly is stopped), the inertial force acts on the lock member 60 at the lock position side until the third engagement part 66 is butting against the release button 50 (setting is possible in view of the relationship between the fixed part and the center of gravity), the lock member 60 is rendered in a state to be urged at the lock position side so that the lock member 60 stays at the lock position.

What is claimed is:

1. A buckle device provided with a tongue plate connected to a webbing, and a buckle body through which the insertion and release of the tongue plate is implemented, characterized in that the buckle body comprises a frame, a hook member rotatably provided on the frame, rotatable at the time of insertion of the tongue plate to engage with the tongue plate, and always urged in a direction to release the engagement thereof, a release button for implementing the release of engagement between the hook member and the tongue plate, a lock bar moving to a position for allowing the rotation thereof in the direction to release the engagement of the hook member while being pushed by the release button at the time of engagement releasing operation of the release button, and moving to a position where the rotation thereof is restrained in the direction to release the engagement of the hook member by an urging force of an urge member in a state of engagement with the tongue plate, a lock member rotatably pivotally supported by the frame between a lock position where the lock bar is locked and an unlock position where the lock bar is unlocked, and the urge member for elastically urging the lock member toward the unlock position, wherein the lock member comprises a base end part pivotally supported by the frame, a first engagement part formed on substantially the central portion of the base end part, a second engagement part formed opposite to the first engagement part while leaving a space through which the lock bar can be received, and a third engagement part provided opposite to the second engagement part and capable of entering a movement area of the release button, and wherein in a state where the lock member is positioned at the lock position, the lock member is rotated toward and held at the lock position when the lock bar is butted against the first engagement part, thereby causing the second engagement part to enter a movement area of the lock bar, while in the case where an inertial force in a direction of the insertion of the tongue plate is exerted at a value exceeding a predetermined value, the release button is butted against the third engagement part, thereby preventing the lock member from being rotated toward the unlock position to hold the lock position.

2. A buckle device according to claim 1, characterized in that a rotative force is generated in the lock member toward the unlock position when the lock bar is butted against the second engagement part in case of emergency, and a movement distance is provided so as to cause the release button to be butted against the third engagement part before or simultaneously with the movement of the lock member toward the second engagement part.

3. A buckle device according to claim 1 or 2, characterized in that the lock member is rotatably pivotally supported by the frame by way of a pivotally support part which is eccentric from the center of gravity of the lock member, and an inertial force by which the lock member is rotated toward the lock position side is exerted owing to an inertial force in the direction of insertion of the tongue plate.

* * * * *